United States Patent [19]

Minasy

[11] 4,074,249

[45] Feb. 14, 1978

[54] MAGNETIC DETECTION MEANS

[75] Inventor: Arthur J. Minasy, Woodbury, N.Y.

[73] Assignee: Knogo Corporation, Hicksville, N.Y.

[21] Appl. No.: 765,582

[22] Filed: Feb. 4, 1977

[51] Int. Cl.[2] ..... G08B 13/26

[52] U.S. Cl. ..... 340/280; 324/234; 340/258 C

[58] Field of Search ..... 340/280, 258 C; 324/41

[56] References Cited

U.S. PATENT DOCUMENTS

| | | | |
|---|---|---|---|
| 3,665,449 | 5/1972 | Elder et al. | 340/280 |
| 3,697,996 | 10/1972 | Elder et al. | 343/101 |
| 3,747,086 | 7/1973 | Peterson | 340/280 |
| 3,765,007 | 10/1973 | Elder | 340/280 |
| 3,790,945 | 2/1974 | Fearon | 340/280 |
| 3,820,103 | 6/1974 | Fearon | 340/280 |
| 3,820,104 | 6/1974 | Fearon | 340/280 |
| 4,000,488 | 12/1976 | Ephraim | 340/280 |

FOREIGN PATENT DOCUMENTS

| | | |
|---|---|---|
| 763,681 | 5/1934 | France. |

*Primary Examiner*—Glen R. Swann, III

*Attorney, Agent, or Firm*—Fitzpatrick, Cella, Harper & Scinto

[57] ABSTRACT

Magnetic detection means for protection of articles such as books, records and the like, wherein a target, of magnetically soft or easily saturable magnetic material, such as permalloy foil, is mounted on the protected article and emits magnetic signals which are harmonics of an interrogating magnetic field generated at an exit station. The target is curved along its length and provides good signal response over a wide range of orientation.

11 Claims, 8 Drawing Figures

Fig. 1.
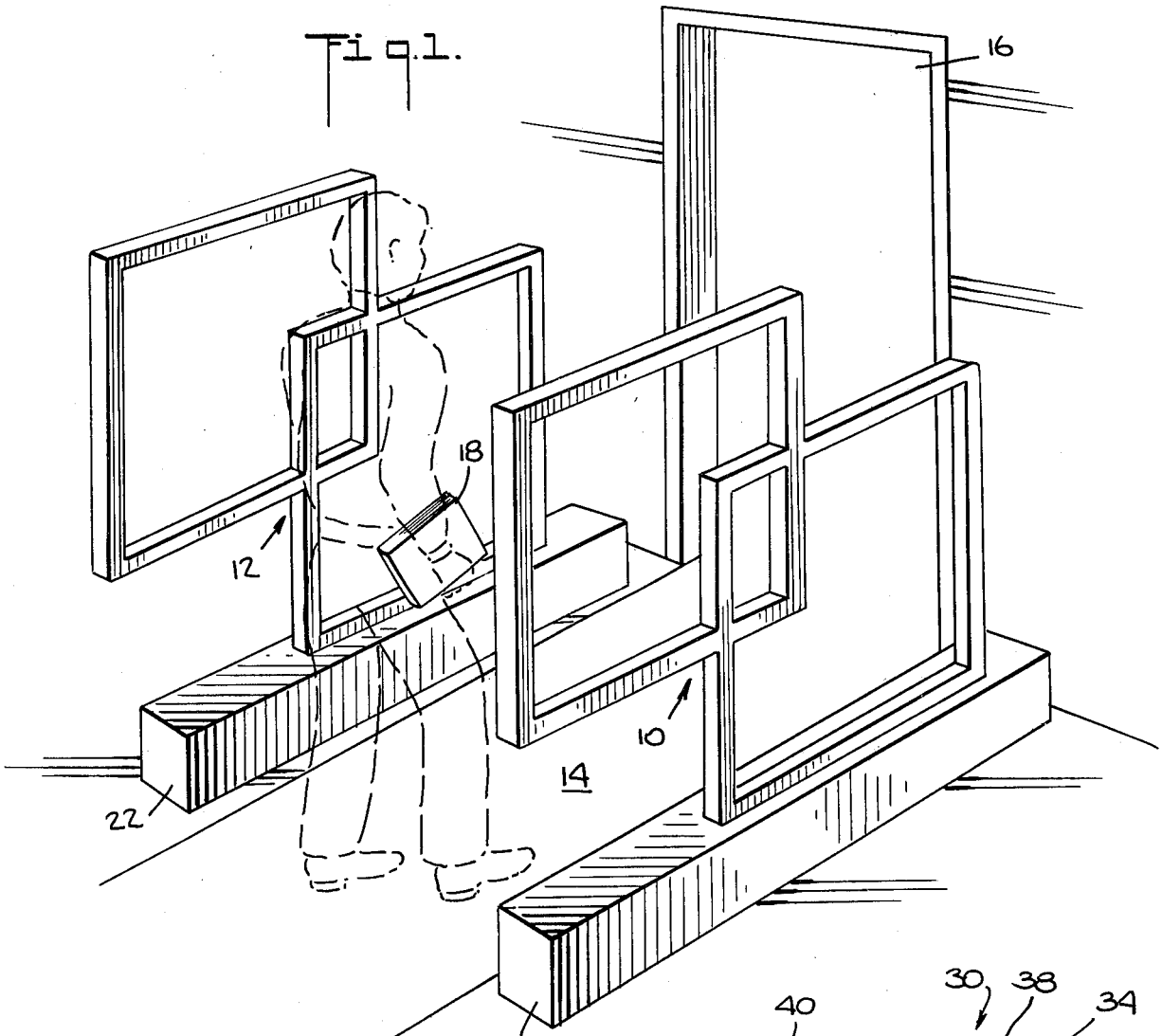
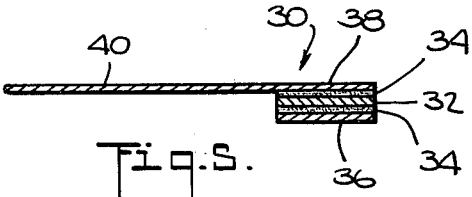
Fig. 5.
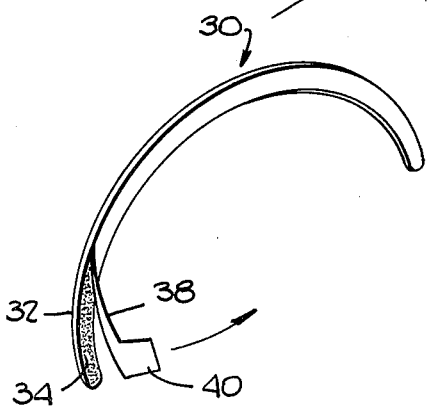
Fig. 6.
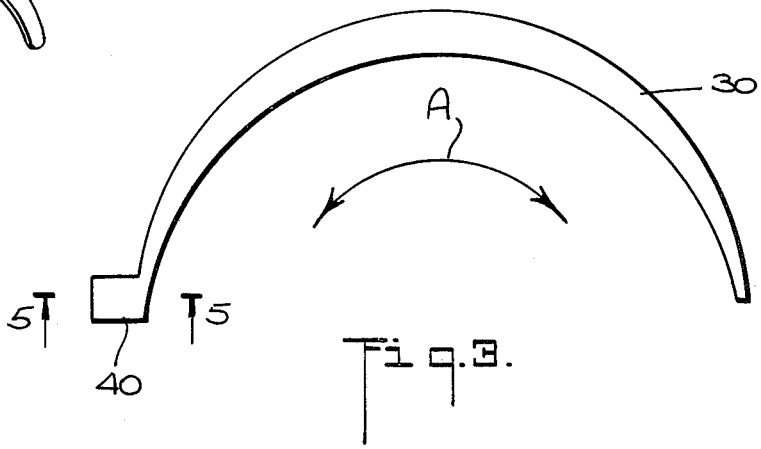
Fig. 3.

B-STRAIGHT TARGET 18 CM LENGTH
A- SEMI-CIRCULAR TARGET-10 CM DIA.
D-"X" SHAPED TARGET 10 CM X 10 CM
E-"L" SHAPED TARGET 10 CM X 10 CM
C-STRAIGHT TARGET 10 CM LENGTH
+90° +70° +50° +30° +10° 0 -10° -30° -50° -70° -90°
13 12 11 10 9 8 7 6 5 4 3 2 1
VOLTS PEAK TO PEAK

MAGNETIC DETECTION MEANS

BACKGROUND OF THE INVENTION

1. Field of the Invention

This invention relates to article detection systems such as are used to protect articles from theft. More particularly the invention provides improvements which enhance the sensitivity and reliability of such article detection systems.

2. Description of the Prior Art

French Pat. No. 763,681 to Pierre Arthur Picard discloses a magnetic type article detection system which is used to protect library books from theft. In the Picard system an electrical coil is provided at the doorway of the library and it is electrically energized to generate a varying magnetic fundamental frequency field, through which all books must pass as they are taken from the library. The books are each provided with a target made of an elongated strip of ferromagnetic material of high magnetic permeability; and as this strip passes through the varying magnetic field at the doorway the field causes the strip to generate other fields at various harmonic frequencies. A sensing means is also provided at the doorway to sense the presence of those harmonic frequencies which are characteristic of the target material.

Picard also discloses that if the target material is of elongated configuration, the induction, i.e. its magnetic effect, will be high. A number of U.S. patents subsequent to Picard, i.e. U.S. Pat. Nos. 3,665,449, 3,697,996, 3,747,086, 3,765,007, 3,790,945, 3,820,103 and 3,820,104, say the same thing.

The Picard patent also discloses the use of target antennas which extend in two planes to decrease orientation sensitivity. This idea of a multidimensional target or responder to decrease orientation sensitivity is also recognized in U.S. Pat. No. 3,697,996. The term "orientation sensitivity" is used herein to mean the variation in the strength of the response signal produced by a target or responder strip when it is turned or reoriented with respect to the doorway coil which generates the fundamental frequency field.

It is important that the responder strip have minimal orientation sensitivity because books or other protected articles, on which the responder strips are mounted, may be oriented in any of several planes as they pass through the fundamental frequency field. It is, of course, possible to provide different strips arranged in different planes on the protected articles, or to provide "L" or "T" shaped strips, as recognized in the prior art, in order to minimize orientation sensitivity. However, such arrangements are bulky and expensive and they are often impractical for incorporation into various articles.

SUMMARY OF THE INVENTION

The present invention overcomes the above described deficiencies of the prior art. With the present invention there is provided a magnetic type article detection system which is characterized by minimal orientation sensitivity and which at the same time requires less material and less space for the target material than is required in prior art systems of similar sensitivity. This detection system includes a novel target or responder which is made from a strip of readily saturable magnetic material such as permalloy foil. The target strip is elongated and is curved along its length. The target is preferably semi-circular or crescent shaped with tapered ends. It has been found that this target configuration provides a high level signal response over a large range of target orientation; and that for a given amount of target material the signal response characteristics of the target of the present invention are superior to those of the prior art.

BRIEF DESCRIPTION OF THE DRAWINGS

A single embodiment of the invention has been chosen for purposes of illustration and description and is shown in the accompanying drawings forming a part of this specification wherein:

FIG. 1 is a perspective view of a detection system in which the present invention is embodied;

FIG. 3 is an enlarged side elevational view of a novel target according to the present invention;

FIG. 5 is an enlarged section view taken along line 5—5 of FIG. 3;

FIG. 6 is a perspective view of the target of FIG. 3 showing the manner in which the target is prepared for attachment to an article to be protected;

DETAILED DESCRIPTION OF THE PREFERRED EMBODIMENT

Figure 2:
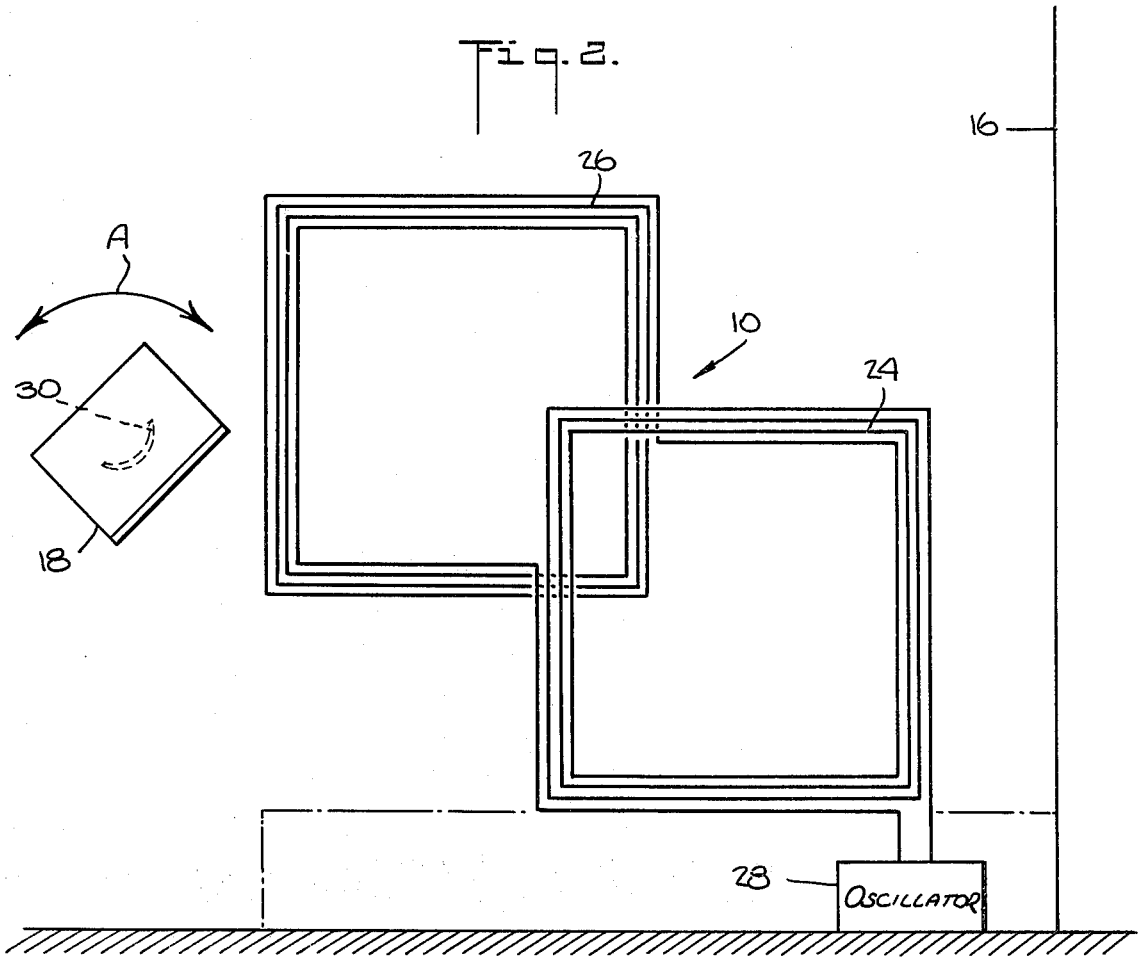
FIG. 2 is a side elevational view of one side of the system of FIG. 1 and showing an antenna winding arrangement.

The detection system of FIG. 1 comprises a transmitting antenna cluster 10 and a receiving antenna cluster 12 arranged on opposite sides, respectively, of a passageway 14 leading to an exit such as a doorway 16. The doorway 16 provides limited egress from a protected area, such as a reading room book checkout location of a library. When a patron (shown in phantom outline) wishes to depart from the protected area he must walk along the passageway 16 between the antenna clusters 10 and 12. Any article carried by the patron, such as a book 18 is thus subjected to the influence of the antenna clusters.

The antenna clusters 10 and 12 are mounted on pedestals 20 and 22 which rest on the floor on opposite sides of the passageway 14. These pedestals may house electronic circuits appropriate to the antenna clusters 10 and 12. Thus, in the case of the transmitting antenna cluster 10, the electronic circuits energize it so that it produces an alternating electromagnetic field in the passageway. In the case of the receiving antenna cluster, the associated electronic circuits detect characteristic target signals and convert them into alarms.

As shown in FIG. 2, the transmitter antenna cluster 10 includes a pair of rectangularly shaped and partially overlapped coils 24 and 26 connected in series to an oscillator 28. The oscillator produces alternating electrical signals at a predetermined frequency, e.g., 2500 hertz. These electrical signals are converted by the coils 24 and 26 to alternating magnetic fields of the same frequency in the passageway 14. The receiver antenna cluster 12 is similar in configuration to the transmitter antenna cluster; but it is connected to electrical signal amplification, detection and alarm circuits (not shown) which select and convert those magnetic disturbances, which are characteristic of a target, to an audio or visual alarm.

A protected article, such as the book 18, is provided with a target 30 which produces a characteristic electromagnetic response in the presence of the alternating magnetic field by the transmitting antenna cluster 10. More specifically the target 30, which is preferably made of a highly saturable magnetic material, such as permalloy, emits its own alternating magnetic fields when it is energized by the alternating magnetic field from the transmitter antenna cluster 10. Moreover, the magnetic fields emitted by the target 30 are at frequencies which are multiples or harmonics of the frequency of the magnetic field emitted by the transmitter antenna cluster 10. The receiver antenna cluster 12 converts the magnetic fields emitted by the target 30 to electrical signals at the same frequencies and these signals are then amplified and detected. When an electrical signal is detected which is at a predetermined harmonic frequency of the transmitter antenna cluster output an alarm signal is produced. In this way the presence in the passageway 14 of a book or other article carrying a target 30 can be detected. Other articles which do not carry a target 30 or which carry a deactivated target can be brought through the passageway 14 without generating an alarm because such books or articles will not emit magnetic fields at frequencies harmonically related to the fields generated by the transmitter antenna cluster 10.

The system as thus far described is known in the prior art and is explained in greater detail in French Pat. No. 763,681 to Picard and in copending U.S. Patent Application Ser. No. 715,568 filed Aug. 18, 1976.

In the prior art targets which emit alternating magnetic fields at frequencies harmonically related to an interrogating alternating magnetic field were generally made of thin elongated strips of magnetically "soft," i.e. easily saturable, material such as permalloy. However, these targets exhibited an orientation sensitivity; that is, they produced a greater response in the passageway 14 when they were oriented in one direction than they did when they were oriented in another direction. In order to overcome this direction sensitivity it has been proposed to use two target strips arranged at right angles to each other to form an "L," a "T" or an "X" shaped configuration. This, however, required twice the amount of target material; and, where a great number of articles were to be protected, the expense of the targets was unduly high.

The target 30 of the present invention, as shown in FIG. 3, is in the shape of a crescent or an arc. As shown in FIG. 2 the target 30 is positioned in the book 28 so that it lies flat along the inside of the book cover. Now when the book is held in various positions, i.e. when it is turned as indicated by the arrow A, the target 30 will be aligned differently with respect to the various magnetic fields produced by the transmitter antenna cluster 10. In the case of the prior art targets in the shape of a straight strip, the rotational position of the book would have a very substantial effect on the sensitivity of the target. Thus at one rotational position the target would be in alignment with the transmitted magnetic field and would produce a relatively high response whereas at another rotational position the target would be out of alignment with the transmitted magnetic field and would produce a relatively low response. The curved target 30 shown in FIG. 3 serves to produce a response which varies only minimally with changes in orientation.

Figure 4:
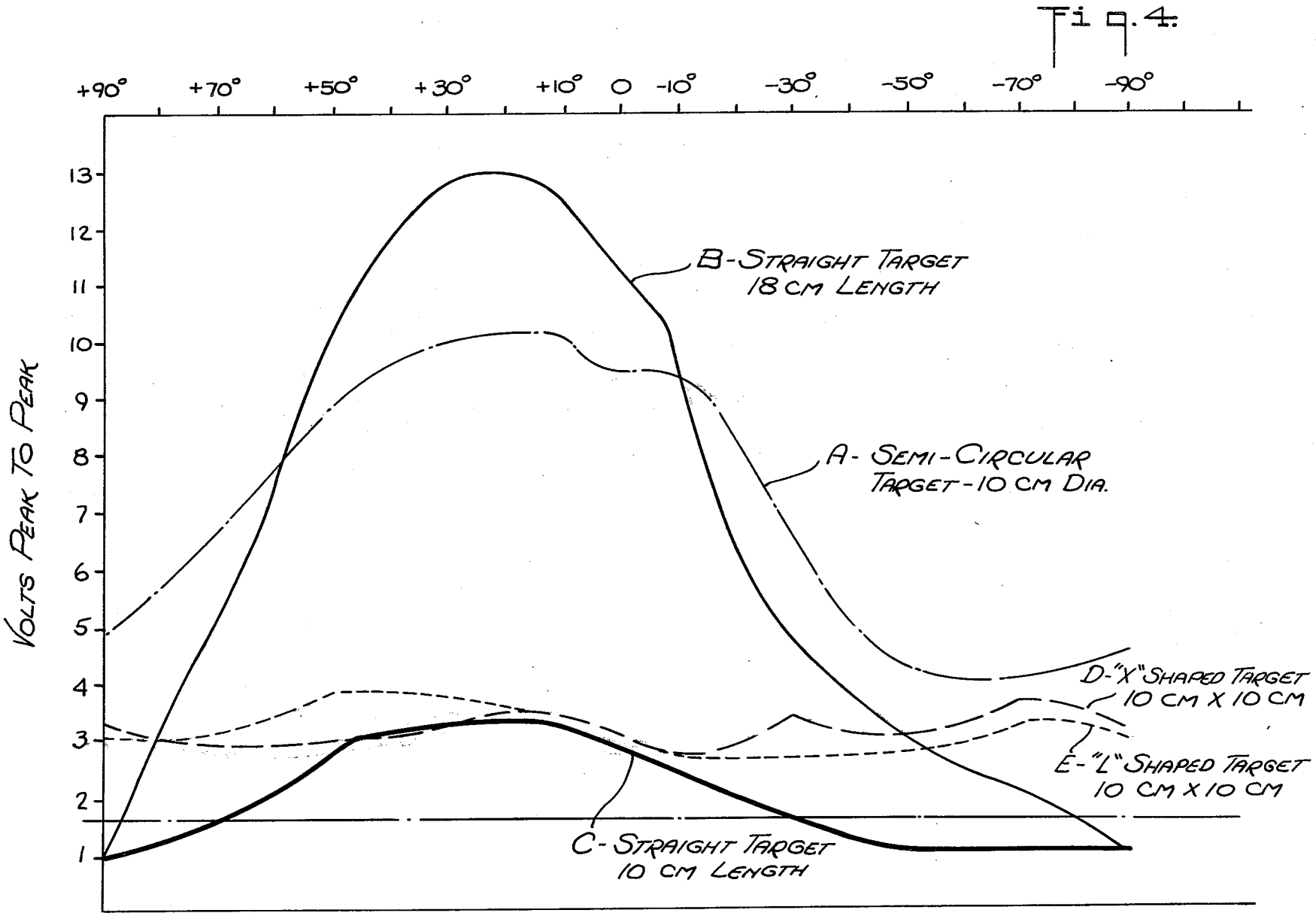
FIG. 4 is a graph illustrating the improved response characteristics of the target of FIG. 3.

The various curves of the graph of FIG. 4 demonstrates the relative responses of different targets at different orientations in a given location along the passageway 14. The different targets used in this comparison are as follows:

| Target | Description |
|---|---|
| "A" | Curved, semi-circular strip of four inch (10 cm) diameter - the target of the present invention. |
| "B" | Straight elongated strip of seven inch (18 cm) length. |
| "C" | Straight elongated strip of four inch (10 cm) length. |
| "D" | "X" shaped target four inches by four inches (10 cm by 10 cm). |
| "E" | "L" shaped target four inches by four inches (10 cm by 10 cm). |

In the graph of FIG. 4 the abcissa represents the angular orientation of each target (i.e., rotation in the direction of the arrow A, FIG. 2) with respect to a given reference orientation (0°); and the ordinate represents the receiver response, in terms of voltage, from each target at the corresponding orientation. Each target is interrogated with the same interrogating alternating magnetic field at the given location in the passageway 14.

As can be seen in FIG. 4, the curved target "A" of the present invention provides the most consistent response at a high signal level over a 180° range of orientation. Although the target "B", i.e. the straight 18 cm strip, provides a higher signal response within a narrow range of orientations, its response is actually less than that of target "A" over the major portion of the range. The targets "C" and "D" provide less response over the entire orientation range than the target "A" of the present invention even though the total length of each of these other targets is much greater than that of target "A". The target "E", of course, provides considerably less response than each of the others over the entire range of orientation.

Turning now to FIG. 5 it will be seen that the target 30 of present invention is preferably formed of a laminate type construction. This laminate comprises a central foil-like layer 32 of the magnetically soft, i.e. easily saturable magnetic material, such as permalloy, with an adhesive layer 34 on each side thereof. An outer cover layer 36 of paper or the like is provided on one of the adhesive layers 34 and a layer 38 of release paper is provided on the other adhesive layer. The release paper layer 38, as shown in FIG. 3 is formed with a grip tab 40 at one end, which extends out beyond the other layers.

Figure 7:
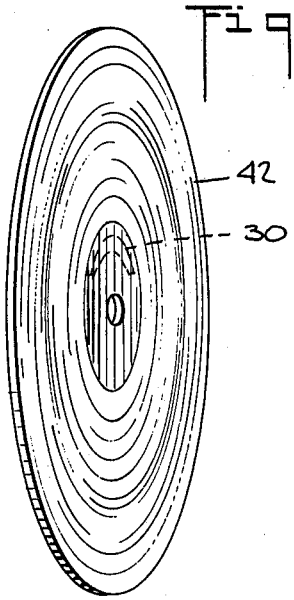
FIG. 7 is a perspective view showing the application of the target of FIG. 3 to a phonograph record.

In its configuration as described above the target 30 may be handled easily without substantial danger of breakage. When it is desired to protect an article with the target 30, the grip tab 40 is pulled away from the target 30, as shown in FIG. 6 to remove the release paper layer 38 and expose the underlying adhesive layer 34. The target 30 may then be pressed against the article and held in place by the adhesive layer. The cover layer 36 will both protect and conceal the target. It will be seen in FIG. 7 that the configuration of the target 30 readily adapts it for use on the spindle region of a phonograph record 42.

Figure 8:
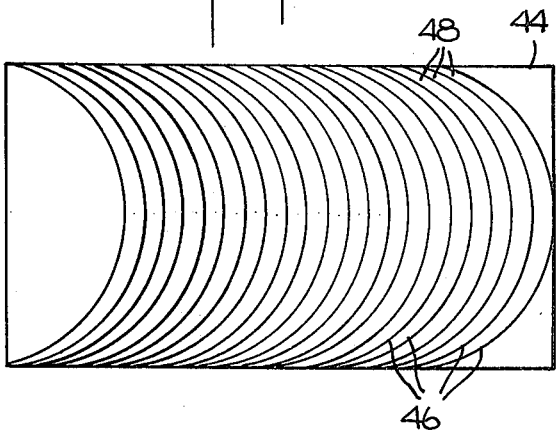
FIG. 8 is a plan view illustrating how plural targets according to the present invention are formed from a continuous web of target material.

It has been found that it is not necessary for the target 30 to have a uniform width and that satisfactory performance can be obtained where the ends of the target paper toward a point, i.e. where the target is crescent shaped. This characteristic makes it possible to manufacture large numbers of these targets from a continuous web of permalloy foil with a minimum of waste. FIG. 8 illustrates a web 44 of permalloy foil which is severed, as by stamping, along curved lines 46 to form curved strips 48. The foil web 44 may be pre-laminated with the adhesive layers 34, the outer cover layer 36 and the release paper layer 38 prior to stamping on severing into individual targets. The release paper layer may be made somewhat wider than the web 44 in order to form the grip tabs 40.

It has been found that targets with good response can be produced from a permalloy foil web of four inch (10 cm) width. This provides a semicircular target with an effective length of one half $4\pi$ or six and one quarter inches (16 cm), which conveniently fits on books, phonograph records and many other articles, and at the same time produces a reliable response signal at various orientations.

Having thus described the invention with particular reference to the preferred form thereof, it will be obvious to those skilled in the art to which the invention pertains, after understanding the invention, that various changes and modifications may be made therein without departing from the spirit and scope of the invention as defined by the claims appended hereto.

What is claimed and desired to be secured by Letters Patent is:

1. A magnetic detection system comprising means forming an exit passageway from an enclosure, means for generating an interrogating magnetic field which varies at a given frequency in said passageway, at least one target secured to an article capable of being carried through said passageway, said target comprising an elongated strip of readily saturable magnetic material capable of producing magnetic fields at frequencies which are harmonics of the frequency of an incident magnetic field, said strip being curved along its length, and detection means arranged to detect magnetic fields in the vicinity of said passageway which vary at selected ones of said harmonics.

2. A magnetic detection system according to claim 1 wherein said strip is of permalloy foil.

3. A magnetic detection system according to claim 1 wherein said strip is of semi-circular configuration.

4. A magnetic detection system according to claim 1 wherein said strip is crescent shaped.

5. A magnetic detection system according to claim 4 wherein said strip is tapered at its ends.

6. A target for a magnetic detection system of the type in which an alternating interrogating magnetic field is generated at an exit passageway and magnetic fields, which alternate at frequencies harmonically related to the interrogating field, are detected at said passageway, said target comprising an elongated strip of readily saturable magnetic material, said strip being curved along its length.

7. A target according to claim 6 wherein said strip is of permalloy foil.

8. A target according to claim 6 wherein said strip is of semi-circular configuration.

9. A target according to claim 6 wherein said strip is crescent shaped.

10. A target according to claim 9 wherein said strip is tapered at its ends.

11. A target according to claim 6 wherein said target includes an adhesive layer on each surface of said strip and a outer protective covering over one of said adhesive layers.

* * * * *

UNITED STATES PATENT AND TRADEMARK OFFICE

CERTIFICATE OF CORRECTION

PATENT NO. : 4,074,249

DATED : February 14, 1978

INVENTOR(S) : ARTHUR J. MINASY

It is certified that error appears in the above-identified patent and that said Letters Patent are hereby corrected as shown below:

Column 5, line 4, "paper" to read -- taper --.

Signed and Sealed this

Sixth Day of June 1978

[SEAL]

*Attest:*

RUTH C. MASON
*Attesting Officer*

DONALD W. BANNER
*Commissioner of Patents and Trademarks*